US005311799A

United States Patent [19]

Mohr

[11] Patent Number: 5,311,799

[45] Date of Patent: May 17, 1994

[54] PROCESS AND APPARATUS FOR CUTTING STACKED SHEET-LIKE MATERIAL IN MORE THAN ONE DIRECTION WITH A SINGLE CUTTING KNIFE

[76] Inventor: Wolfgang Mohr, Hundshager Weg 42, D-6238, Hofheim/Taunus, Fed. Rep. of Germany

[21] Appl. No.: 22,693

[22] Filed: Mar. 1, 1993

Related U.S. Application Data

[63] Continuation of Ser. No. 691,462, Apr. 25, 1991.

[30] Foreign Application Priority Data

Apr. 26, 1990 [DE] Fed. Rep. of Germany ..... 4013418

[51] Int. Cl.[5] ..... B26D 5/20; B26D 7/01

[52] U.S. Cl. ..... 83/36; 83/167; 83/278; 83/280; 83/468.6

[58] Field of Search ..... 83/35, 36, 44, 45, 47, 83/404.2, 408, 425.2, 437, 435.1, 467.1, 468.6, 733, 167, 249, 268, 278, 279, 280; 414/417, 752, 781

[56] References Cited

U.S. PATENT DOCUMENTS

| | | | |
|---|---|---|---|
| 3,688,619 | 9/1972 | Yabuta | 83/35 |
| 4,317,397 | 3/1982 | Ess | 83/35 |
| 4,361,062 | 11/1982 | Reiff | 83/36 X |
| 4,392,401 | 7/1983 | Ess | 83/36 X |
| 4,397,598 | 8/1983 | Ess et al. | 83/468.6 X |
| 4,811,640 | 3/1989 | Fritsch | 83/36 X |
| 4,815,349 | 3/1989 | Urs | 83/404 |
| 4,850,257 | 7/1989 | Mohr | 83/93 |
| 5,002,108 | 3/1991 | Jenkner | 83/468.6 X |

FOREIGN PATENT DOCUMENTS 2911473 9/1980 Fed. Rep. of Germany .

*Primary Examiner*—Eugenia Jones

*Attorney, Agent, or Firm*—Robert P. Simpson; Michael L. Dunn

[57] ABSTRACT

A process and apparatus are provided for transferring material cut in transverse strips and located on an exit zone of an apparatus for the cutting of stacked sheet-like material, to an entry zone of the apparatus for the purpose of cutting such material into longitudinal strips. The apparatus has a cutting table with a table surface possessing a work zone, above which a cutting knife and a press bar are located. An advance device located in the entry zone is provided for the material to be cut. The material present in transverse strips is brought from the exit in zone onto a thin-walled, plate-shaped transport base. The transport base, together with the material, is fed, via at least one table which is arranged laterally of the apparatus and the table surface of which can be arranged level with that of the cutting table of the apparatus, to the entry zone of the apparatus and there, aligned with the entry zone, is removed from the transport base. The material to be cut is rotated out of the transverse direction into the longitudinal direction while being brought onto the transport base or together with the transport base or after removal from the transport base. The material to be cut is thus guided past the actual cutting device, and in the apparatus according to the invention, this purpose is served by arranging at least one table laterally of the cutting device.

21 Claims, 4 Drawing Sheets

PROCESS AND APPARATUS FOR CUTTING STACKED SHEET-LIKE MATERIAL IN MORE THAN ONE DIRECTION WITH A SINGLE CUTTING KNIFE

This is a continuation, of application Ser. No. 07/691,462, filed Apr. 25, 1991.

BACKGROUND OF THE INVENTION

The invention relates first to a process for transferring material cut in transverse strips and located on an exit zone of an apparatus for the cutting of stacked sheet-like material to an entry zone of the apparatus for the purpose of cutting this material into longitudinal strips, the apparatus having a cutting table with a table surface possessing a work zone, above which a cutting knife and a press bar are located, behind which is the entry zone for receiving the material to be cut and in front of which is the exit zone for receiving the cut material, and an advance device assigned to the entry zone being provided for the material to be cut.

It is known, for the subsequent longitudinal cutting of material cut in transverse strips, to rotate this through 90° on the exit zone, so that the cut transverse strips are now longitudinally orientated, and thereafter to press the material back over the work zone, that is to say through under the cutting knife and press bar and onto the entry zone, in order subsequently to instigate once again the mechanical cutting operation, in which, for the purpose of the next item cuts, the advance device advances the material located on the entry zone into the region of the work zone where the cuts are made by means of the cutting knife at specific item intervals. Apart from the fact that the stack of cutting material conventionally present in cuboid form has hitherto been pushed back manually and a considerable expenditure of force is required for this, the attendant is additionally endangered because he has to work constantly in the region of the cutting knife and of the press bar. Quite apart from this, the attendant has to align the material to be cut with the entry zone from the exit zone, and therefore the aligning operation becomes extremely complicated.

The object of the present invention is first to provide a process which allows a work flow during the longitudinal cutting of stacked sheet-like material after it has been cut transversally.

SUMMARY OF THE INVENTION

In a process of the type mentioned in the introduction, the object is achieved in that the material present in transverse strips and to be cut into longitudinal strips is brought from the exit zone onto a thin-walled, plate-shaped transport base, and the transport base, together with the material, is fed, via at least one table which is arranged laterally of the apparatus and the table surface of which can be arranged level with that of the cutting table of the apparatus, to the entry zone of the apparatus and there, aligned with the entry zone, is removed from the transport base, the material being rotated out of the transverse direction into the longitudinal direction while being brought onto the transport base or together with the transport base or after removal from the transport base.

According to the invention, after the transverse cuts have been made, the material can be cut in its longitudinal direction by being brought laterally from the exit zone back to the entry zone of the apparatus.

During the movement of the material from the exit zone to the entry zone, material placed on the entry zone can already be being cut, so that the cutting machine integrated in the process can be operated continuously.

DESCRIPTION OF THE PREFERRED EMBODIMENTS

Figure 1:
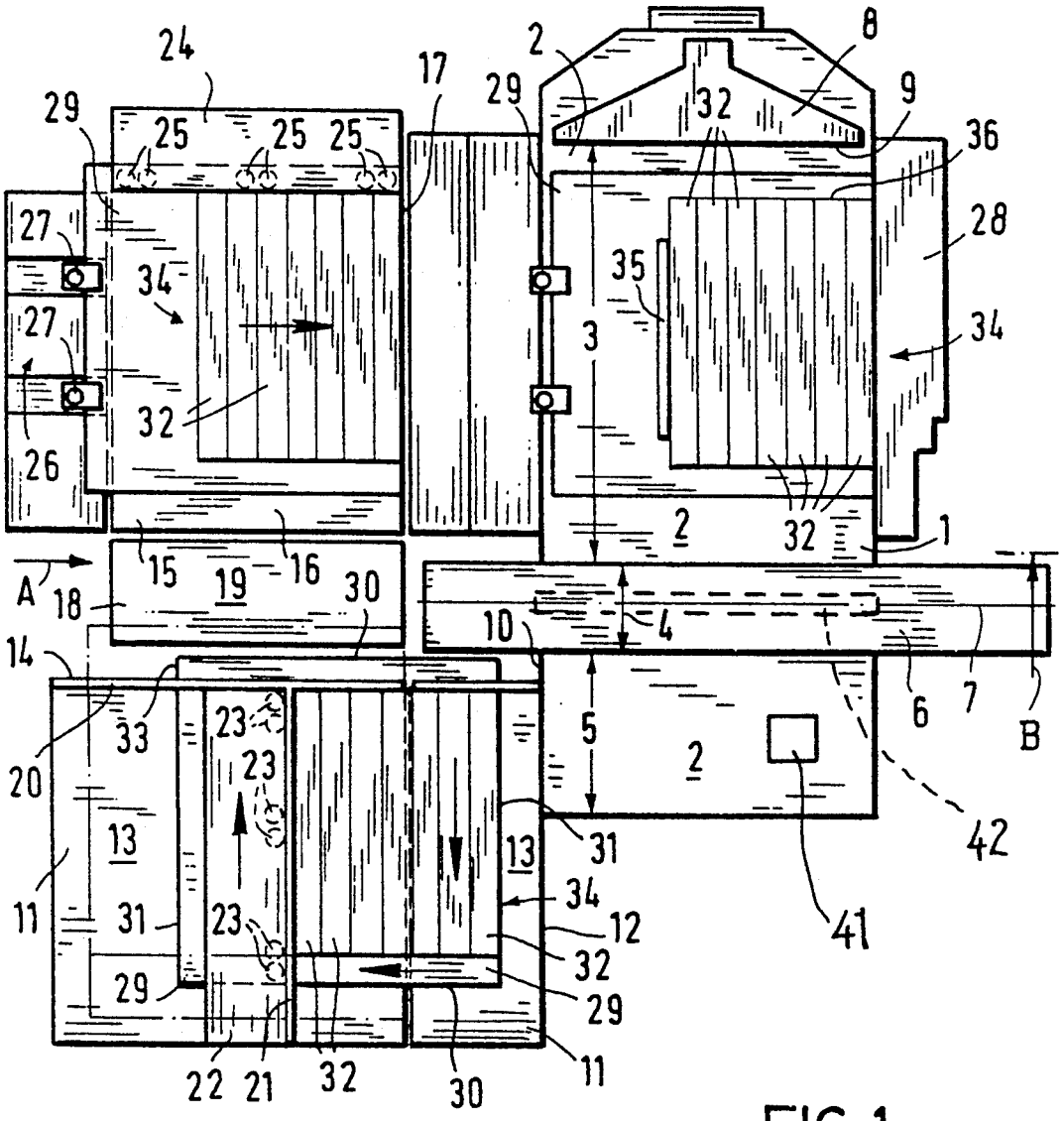
FIG. 1 shows a top view of the apparatus of the invention illustrated in greatly simplified form.

It is considered especially expedient if the material present in transverse strips is brought rotated in the longitudinal direction onto the transport base. The material to be cut thus assumes its final orientation before a transport movement of the transport base from the work zone to the entry zone, and therefore it is essentially merely necessary to ensure that the material is aligned specifically on the entry zone, so that it can be fed to the work zone by means of the advance device. In this respect, the transport base is expediently positioned adjacent to the exit zone on the table and a first aligning stop arranged parallel to the cutting plane and a second aligning stop arranged perpendicularly to this are lowered onto the transport base. The rotated material is aligned at these two aligning stops, and after the stops have been moved out of their positions bearing against the material the transport base together with the material is moved into the region of the entry zone. Advantageously, the transport base together with the material should be displaced onto the entry zone against a side stop assigned to this and a stop be moved behind the material in the direction of movement of the transport base, the transport base being drawn out from under the material in the opposite direction of movement. The stop coming behind the material should execute such a movement that it once again clamps the material already aligned in the region of the exit zone and therefore before the movement of the transport base between itself and the side stop assigned to the entry zone, the alignment of the material on the entry zone finally taking place perpendicularly to this by means of the advance device.

According to a special embodiment of the invention, the surface of the transport base is not loaded completely with material and the movement of the transport base takes place by means of suction devices, grab devices or the like which engage on the transport base in the uncovered region of the latter.

The table arranged laterally of the cutting table can be made one-part or multi-part. With the multi-part design, the table surfaces of the table parts can be raised and/or lowered with respect to their level in relation to the table surface of the cutting table. This can be desirable, for example, when there are arranged especially laterally of the work zone auxiliary units for carrying out the cutting operation which make it necessary to transport the transport base above the auxiliary unit or auxiliary units. Should the width of the auxiliary unit or auxiliary units be small, the gap formed between the table parts arranged laterally of these can be easily bridged by means of the transport base together with the material located on it. In contrast, if there is a larger gap, the surface of the particular auxiliary unit itself is to be designed as the table surface and the adjacent table parts together with their table surfaces are to be brought level with this.

The invention relates, furthermore, to an apparatus for the cutting of stacked sheet-like material, with a cutting table having a table surface possessing a work zone, above which a cutting knife and a press bar are located, behind which is an entry zone for receiving the material to be cut and in front of which is an exit zone for receiving the cut material, and with an advance device assigned to the entry zone and intended for the material to be cut. In an apparatus of this type, it is proposed, according to the invention, that there be arranged laterally of the cutting table, a further table, the table surface of which can be positioned level with the table surface of the cutting table, one end of the table being arranged adjacent to the exit zone and the other end of the table adjacent to the entry zone. If the table surfaces of the cutting table and of the further table are positioned level with one another, transversally cut material can be guided laterally past the actual cutting machine and be fed to the entry zone of the cutting table, without the need to displace the material over the work zone, that is to say under the cutting knife and the press bar and through. Advantageously, the further table possesses a first table part laterally of the exit zone and a second table part laterally of the entry zone, the table parts being positionable in one plane and being arranged adjacent to one another and to the cutting table. A region of one table part can be designed as a raisable and lowerable lateral jib assigned to the work zone, in the lowered position its upper surface forming one plane with the table surface of the remaining region of this table part. For aligning the material the first table part is expediently equipped with an aligning stop arranged perpendicularly to the cutting plane and a further aligning stop arranged parallel to the cutting plane. Should the aligning stops be in the direction of the movement of the material during the transfer from the exit zone to the entry zone, they should be removable, especially raisable, lowerable or horizontally movable, out of the region of the material. Additionally, the second table part can be equipped with an aligning stop arranged parallel to the cutting plane and intended for the material to be cut. Finally, for the concluding alignment of the material on the entry zone of the cutting table, the latter is equipped with a side stop arranged perpendicularly to the cutting plane.

Further features of the invention are shown in the description of the figures and in the subclaims, and it is noted that all the individual features and all combinations of individual features are essential to the invention.

FIGS. 1 to 10 illustrate a possible process according to the invention in terms of a practicable version of an apparatus, without being restricted to such a process.

FIG. 1 shows a top view of the apparatus illustrated in greatly simplified form. A cutting table 1 has a horizontal table surface 2 which is composed of an entry zone 3, of a work zone 4 located in front of this and of an exit zone 5 located further in front of it. The table surface 2 is rectangular. Mounted in a gantry 6 extending above the work zone 4 is a cutting knife 42, the cutting plane of which is perpendicular to the sheet plane through the line 7, and furthermore a press bar is mounted in the gantry 6 on the side of the cutting knife facing the entry zone 3. On the side of the entry zone 3 facing away from the gantry 6, there is adjacent to this an advance saddle 8 which is movable in the longitudinal direction of the table surface 2 and of which the laying surface 9 for the material to be cut is arranged parallel to the cutting plane 7.

Adjacent to the exit zone 5 on the side 10 of the latter is arranged a table part 11 with its narrow side 12, this only partially overlapping the side 10. The table part 11 has a rectangular table surface 13 and with its longitudinal side 14 arranged parallel to the cutting plane 7 is located slightly at a distance from the gantry 6, so that the table part 11 bears directly against the cutting table 1 over the greatest length of the side 10 of the exit zone 5. The table surface 13 of the table part 11 conventionally forms one plane with the table surface 2 of the cutting table 1, but with the table part 11 being raisable.

Arranged adjacent to the entry zone 3 is a second table part 15 which likewise has a rectangular table surface 16. The table part 15 is directly adjacent with its longitudinal edge of the entry zone 3. The two table parts 11 and 15 are at a distance from one another corresponding to the width of the gantry 6, the space between the table parts 11 and 15 being occupied by a housing 18, in which is mounted a lateral jib movable in direct proximity to the cutting plane 7 in the longitudinal direction of the gantry 6 into the space between the cutting knife and the press bar. The housing 18 is made plane on top and thus virtually constitutes a further table part with a table surface 19. The table parts 11 and 15 can be raised together with their table surfaces 13 and 16 to the level of the table surface 19.

Arranged on the side of the table part 11 facing the housing 18 is a stop 20 extending parallel to the cutting plane 7, lowerable onto the table surface 13 and oriented perpendicularly to the table surface 13. A further stop 21 is arranged perpendicularly to the stop 20 above the table part 11. Movable in the longitudinal direction of the table part 11 and therefore in the direction of the cutting plane 7 is a further gantry 22 which is arranged in the transverse direction of the table part 11 and which, as seen over its length, is equipped with a plurality of suction elements 23. A further gantry 24 is movable up to the table part 11 in the longitudinal direction of the table part 15, hence perpendicularly to the cutting plane 7 above this table part and the housing 18. The gantry 24 extends in a transverse direction of the table part 15 and likewise has various suction elements 25 over its length. A clamping device 26 is movable in the transverse direction of the table part 15 from the side of the table part facing away from the entry zone 3 as far as the advance saddle 8. The clamping device 26 possesses, as seen in the longitudinal direction of the table part 15, two clamping elements 27 arranged at a distance from one another. On the side facing away from the table part 15, the cutting table 1 is equipped with a side stop 28 in the region of its entry zone 3.

The process according to the invention for transferring the material will be described below:

With the advance saddle 8 moved back, an uncut stack of sheet-like material is first placed on the table surface 2 in the region of the entry zone 3 and is aligned at the side stop 28. The uncut stack can be brought from a vibrating table over the table part 15 to the cutting table 1 via a gripper system. Subsequently, the advance saddle 8 is brought to bear against the stack and the latter is advanced into the work zone 4. Item cuts during which the stack is divided into a plurality of transverse strips are then carried out in succession. In the representation of FIG. 1, these transverse strips are designated by the reference numeral 32. The table surface 13 of the table part 11 is positioned at the same level as the table surface 2 of the cutting table 1. Laid onto the table part 11 is a thin-walled, plate-shaped transport base 29 which projects some distance beyond the longitudinal side 14 of the table part 11. The longitudinal sides 30 of the transport base 29 are aligned parallel to the longitudinal side 14 of the table part 11 and the transverse sides 31 of the transport base 29 are aligned parallel to the narrow side 12 of the table part 11. Level with the longitudinal side 14 of the table part 11, the stop 20 is lowered onto the transport base 29. Also lowered onto this is the stop 21 butting against the stop 20 and positioned perpendicularly to this. The gantry 22 is positioned above the half of the table part 11 facing away from the exit zone 5, and its suction elements 23 are lowered onto the surface of the transport base 29.

The transverse strips 32 occurring during cutting are successively pushed onto the thin-walled transport base 29 via the table surfaces 2 and 13 forming one plane and at the same time are rotated through 90° so that, as can be seen in respect of the table part 11, they come to rest perpendicularly to the cutting plane 7. The transverse strips 32 can be brought from the exit zone 5 of the cutting table 1 onto the table part 11 either manually or by means of a rotary gripper 41. The individual transverse strips 32 are aligned successively at the stops 20 and 21. While the transport base 29 is being fed, it can be moved under the stops 20 and 21, resting only loosely on it, in the longitudinal direction of the table part 11 by means of the suction elements 23, in order thereby to make it easier for the individual transverse strips 32 to be delivered onto the transport base 29.

Figure 2:
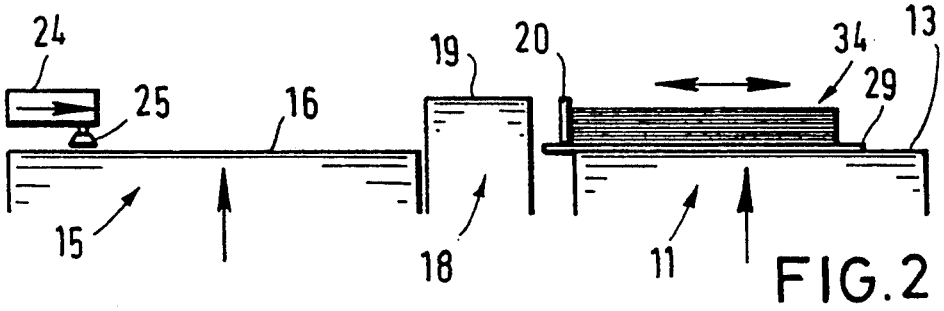
FIG. 2 shows the apparatus of the invention from the viewing direction A in FIG. 1, when the table parts 11 and 15 are in the lowered state with respect to table surface 19.
Figure 3:
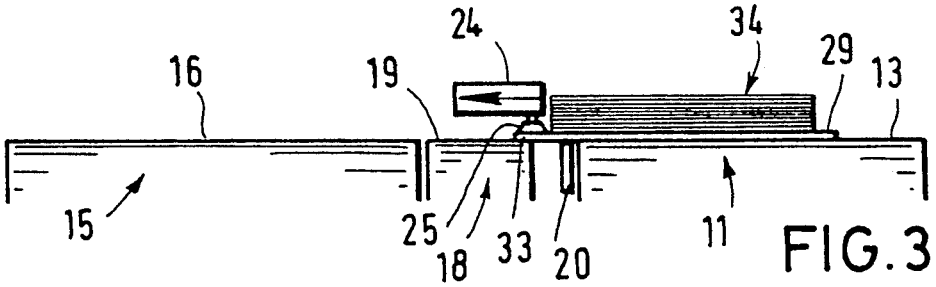
FIG. 3 shows the apparatus of the invention from the viewing direction A in FIG. 1, when the table parts 11 and 15 are in the raised state with respect to table surface 19.
Figure 4:
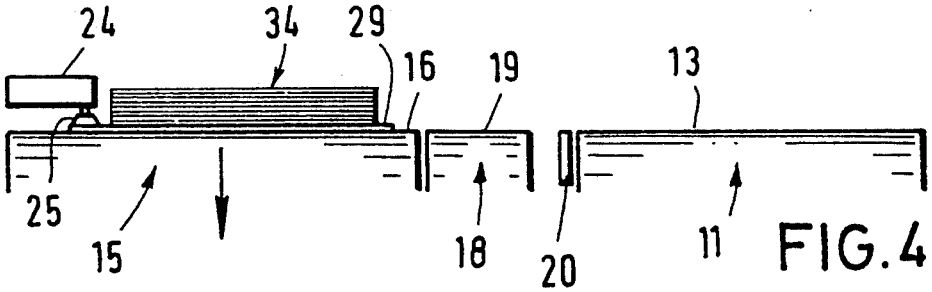
FIG. 4 shows the apparatus of the invention from the viewing direction A in FIG. 1, wherein the transport base 29 is moved together with material 34 onto table part 15.
Figure 5:
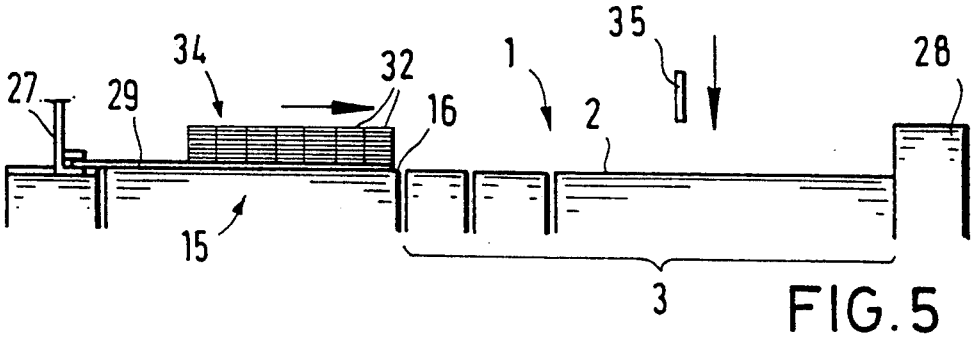
FIG. 5 shows the apparatus of the invention from the viewing direction B of FIG. 1, which shows stop 35 arranged parallel to the side stop 24 before it is lowered onto the transport base 29.
Figure 6:
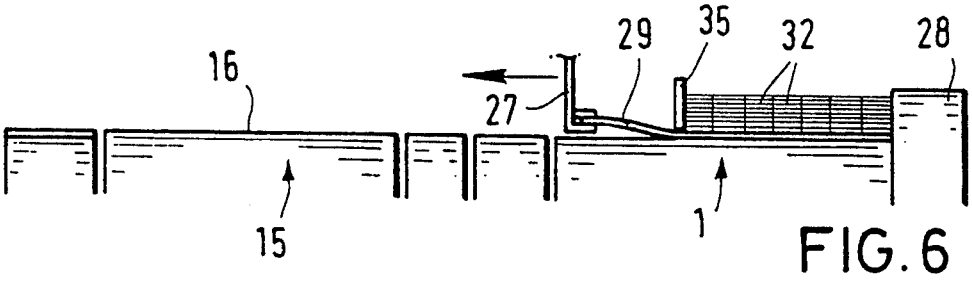
FIGS. 6 and 7 show the apparatus of the invention from viewing direction B of FIG. 1, wherein the transport base 29 is moved out from under material 32 to its position on table part 15.
Figure 7:
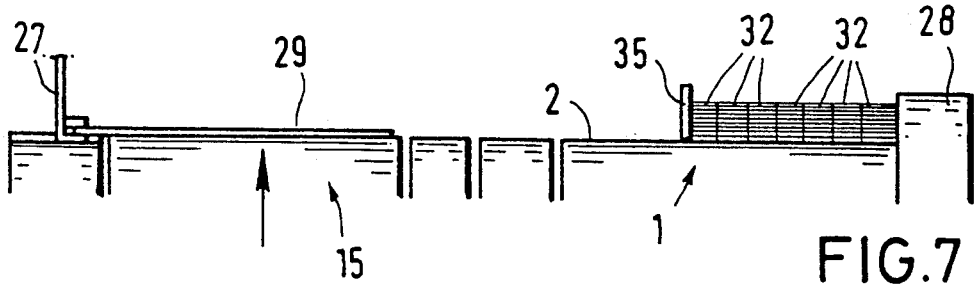
Figure 8:
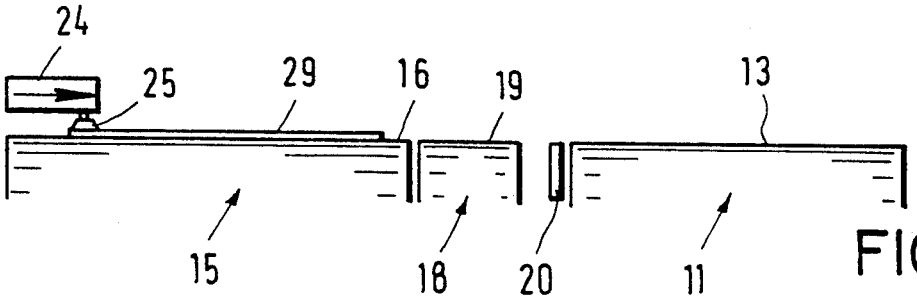
FIGS. 8 to 10 show the apparatus of the invention from viewing direction A of FIG. 1, wherein the transfer base 29 and other components are returned to their initial position.
Figure 9:
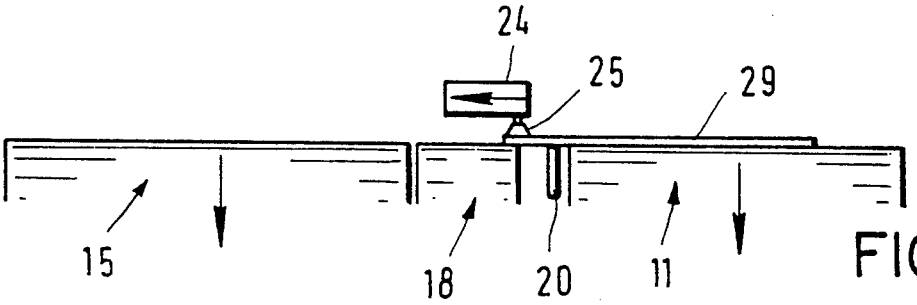
Figure 10:
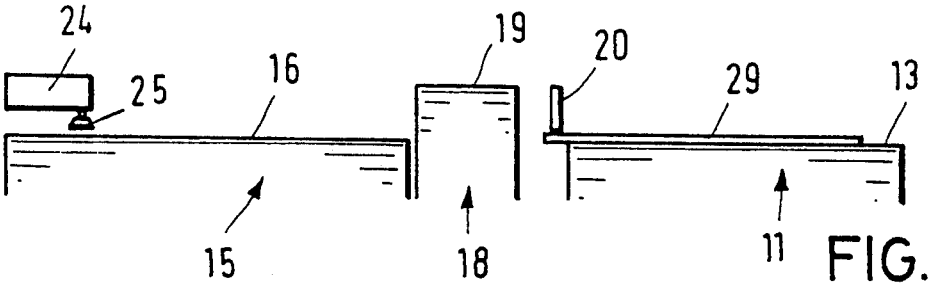

FIG. 1 shows a loaded transport base 29, on which seven transverse strips 32 are positioned and aligned at the stops 20 and 21. Together with the gantry 22 and consequently the suction elements 23, the associated stop 21 is then moved away from the exit zone 5, until the transverse side 31 of the transport base 29 assigned to the exit zone 5 is aligned with the longitudinal edge 17 of the table part 15. The table parts 11 and 15 are then raised level with the table surface 19 of the housing 18, in relation to the viewing direction A according to FIG. 1 the lowered state is shown in FIG. 2 and the raised state in FIG. 3. Previously, the stop 20 has been moved horizontally out of the region of the transport base 29 and the suction elements 23 assigned to the gantry 22 have been raised. As can be seen from the representation of FIG. 2, simultaneously with this lifting movement the gantry 24 arranged in the region of the second table part 15 is moved, together with the suction elements 25, in the direction of the first table part 11 and there the suction elements 25 are lowered onto the region 33 of the transport base 29 projecting beyond the table part 11. As can be seen from the representation of FIG. 4 in the same viewing direction A, thereafter the transport base together with the material 34 located on it is drawn completely onto the table part 15 after which the table part 15 is once again lowered to its initial level and the suction elements 25 are disengaged from the transport base 29. On the side of the transport base 29 facing away from the entry zone 3, the clamping elements 27 of the clamping device 26 grasp the transport base and push this onto the entry zone 3 of the cutting table 1, specifically until the foremost transverse strip 32 bears against the side stop 28. A stop 35 arranged parallel to the side stop 28 is then lowered exactly behind the pushed-over material 34. These conditions are illustrated partially in the representation of FIG. 5 which shows the situation in the viewing direction B according to FIG. 1. After the stop 35 has been lowered onto the transport base 29, the clamping device 26 once again moves in the direction of the table part 15, the transport base 29 thereby being drawn out from under the material 34 formed from the individual transverse strips 32. These conditions are clarified in FIGS. 6 and 7 from the same viewing direction B. Moreover, the last-mentioned figure makes it clear that, after the initial position is reached, the first table part together with the transport base 29 is once again raised level with the table surface 19 of the housing 18. Subsequently, the clamping fences 27 are released from the transport base 29. FIGS. 8 to 19 show, again in the viewing direction A, the further process steps for transferring the transport base 29 into its initial position. According to FIG. 8, the suction elements 25 are once more lowered onto the transport base 29, and this is then displaced relative to the first table part into its initial part. The gantry 24 together with the suction elements 25 is returned to its initial position, subsequently the two table parts 11 and 15 are lowered level with the cutting table 1 and the stop 20 is moved out again. Thereafter, renewed loading of the transport base 29 with transverse strips 32 takes place. During the above-described return of the transport base to the first table part 1 and after the raising of the stop 35, the laying surface 9 of the advance saddle 8 is brought up against the rear side face 36 of the material 34 now present for cutting, and the material is advanced according to the desired thickness of the blocks obtained after the cut.

I claim:

1. A process for cutting stacked sheet-like material in more than one direction with a single cutting knife, comprising:

pushing material to be cut from an entry zone of an apparatus toward said cutting knife located above a cutting table of said apparatus;

cutting said material in a first direction;

placing said cut material on a thin walled, plate-shaped transport base positioned on a first table part located proximate to an exit zone of said cutting table;

rotating said cut material prior to placing it on said transport base;

moving said transport base to said entry zone;

moving said cut material from said transport base onto said entry zone; and pushing said cut material from said entry zone toward said cutting knife to cut said material in a second direction that differs from the first direction in which the material is cut.

2. A process as described in claim 1 wherein said cut material is rotated ninety degrees prior to placement on said transport base.

3. An apparatus for cutting stacked sheet-like material, comprising:

pushing said cut material from said entry zone toward said cutting knife to cut said material in a second direction that differs from the first direction in which the material is cut.

4. An apparatus for cutting stacked sheet-like material, comprising:

a cutting table having a table surface which comprises an entry zone for receiving material to be cut, a work zone proximate said entry zone where said material is cut, and an exit zone proximate said work zone for receiving the material after it is cut;

a gantry mounted above said work zone;

a single cutting knife mounted in said gantry;

an advance saddle located adjacent to said entry zone and operatively arranged to push material to be cut towards said cutting knife;

a transfer table located proximate said exit zone and also located proximate said entry zone; and, a transport base movable on said transfer table and operatively arranged to transport cut material from the exit zone back to the entry zone in order that said material may be re-cut in a direction which is different from a direction in which said material is first cut.

5. Apparatus as recited in claim 4 wherein said transfer table comprises a first table part and a second table part.

6. Apparatus as recited in claim 5 wherein said transport base comprises a thin walled, plate-shaped transport base positioned atop said transfer table, wherein said first table part has a top surface which forms a single plane with a top surface of said cutting table, wherein said transport base is movable on said first table part both toward and away from said exit zone.

7. Apparatus as recited in claim 5 wherein said first table part includes a first aligning stop mounted thereabove and arranged parallel to the cutting knife and a second aligning stop also mounted thereabove and arranged perpendicularly to the first aligning stop, wherein both stops are operatively arranged to be lowered onto said transport base, such that the cut material is aligned at the stops, wherein the stops may be raised out of their position bearing against the cut material prior to said transport base supporting the material being moved toward the entry zone.

8. Apparatus as recited in claim 7 wherein said transport base is operatively arranged to move from said first table part to said second table part and from said second table part to said entry zone to transport said cut material from the exit zone back to the entry zone for re-cutting in a different direction.

9. Apparatus as recited in claim 8 wherein said transport base is operatively arranged to be moved together with the cut material from said second table part to the entry zone such that said cut material is positioned between a first side stop (28) and a second side stop (35), wherein said transport base is operatively arranged to be withdrawn from under said material once the material has been positioned between said first side stop and said second side stop.

10. Apparatus as recited in claim 9 wherein a top surface of the transport base is not covered completely with cut material, and movement of the transport base is achieved by means of holding devices which engage the transport base in the uncovered region thereof.

11. Apparatus as recited in claim 8 further comprising a second gantry mounted above said first table part and a third gantry mounted above said second table part.

12. Apparatus as recited in claim 11 wherein said second gantry includes suction elements operatively arranged to engage said transport base to move said base toward or away from said exit zone.

13. Apparatus as recited in claim 11 wherein said third gantry includes suction elements operatively arranged to engage said transport base to move said base from said first table part to said second table part.

14. Apparatus as recited in claim 11 further comprising a clamping device mounted proximate said second table part and including clamping elements operatively arranged to grasp said transport base and push said transport base and cut material thereon onto said entry zone.

15. Apparatus as recited in claim 14 wherein said transport base is pushed onto said entry zone until said cut material bears against a first side stop mounted atop said entry zone.

16. Apparatus as recited in claim 15 further including a second side stop arranged above said entry zone and parallel to said first side stop mounted atop said entry zone, said second side stop arranged above said entry zone operatively arranged to be lowered onto the transport base, whereupon said transport base is operatively arranged to be withdrawn from under said material in a direction toward said second table part.

17. Apparatus as recited in claim 5 and further comprising a third table part which is a housing located between said first and second table parts, wherein said housing has a top table surface.

18. Apparatus as recited in claim 17 wherein said first and second table part may each be independently raised or lowered with respect to the surface of the cutting table.

19. Apparatus as recited in claim 4 comprising means for rotating said cut material prior to moving said cut material from said exit zone to said transport base.

20. Apparatus as recited in claim 19 wherein said means for rotating said cut material comprises a rotary gripper.

21. Apparatus as recited in claim 20 wherein said rotary gripper grips said cut material from the exit zone and rotates the material 90 degrees before placing the material on the transport base.

* * * * *

UNITED STATES PATENT AND TRADEMARK OFFICE

CERTIFICATE OF CORRECTION

PATENT NO. : 5,311,799

DATED : May 17, 1994

INVENTOR(S) : Wolfgang Mohr

It is certified that error appears in the above-identified patent and that said Letters Patent is hereby corrected as shown below:

Column 7, lines 11-15, please delete Claim 3.

Please add the following claim:

A process for cutting stacked sheet-like material in more than one direction with a single cutting knife, comprising:

pushing material to be cut from an entry zone of an apparatus toward said cutting knife located above a cutting table of said apparatus;

cutting said material in a first direction;

placing said cut material on a thin walled, plate-shaped transport base positioned on a first table part located proximate to an exit zone of said cutting table;

UNITED STATES PATENT AND TRADEMARK OFFICE

CERTIFICATE OF CORRECTION

PATENT NO. : 5,311,799

DATED : May 17, 1994

INVENTOR(S) : Wolfgang Mohr

It is certified that error appears in the above-indentified patent and that said Letters Patent is hereby corrected as shown below:

rotating said cut material together with said transport base;
moving said transport base to said entry zone;
moving said cut material from said transport base onto said entry zone; and
pushing said cut material from said entry zone toward said cutting knife to cut said material in a second direction that differs from the first direction in which the material is cut.

Signed and Sealed this

Thirtieth Day of August, 1994

*Attest:*

*Attesting Officer*

Bruce Lehman

BRUCE LEHMAN

*Commissioner of Patents and Trademarks*